US005221803A

United States Patent [19]

Izumisawa et al.

[11] Patent Number: 5,221,803

[45] Date of Patent: Jun. 22, 1993

[54] TONE SIGNAL GENERATION FROM FEWER CIRCUITS

[75] Inventors: Gen Izumisawa; Yasushi Sato; Akiko Komatsu, all of Hamamatsu, Japan

[73] Assignee: Kabushiki Kaisha Kawai Gakki Seisakusho, Hamamatsu, Japan

[21] Appl. No.: 761,575

[22] Filed: Sep. 18, 1991

[30] Foreign Application Priority Data

Sep. 25, 1990 [JP] Japan ..... 2-251952

[51] Int. Cl.[5] ..... G10H 1/057; G10H 1/08; G10H 1/18

[52] U.S. Cl. ..... 84/653; 84/659; 84/663

[58] Field of Search ..... 84/615, 622, 625, 626, 84/653, 617, 655, 656, 658, 671, 672, 678, 687, DIG. 8, 675, 702, 703, 718; 328/13

[56] References Cited

U.S. PATENT DOCUMENTS

| | | | |
|---|---|---|---|
| 4,109,208 | 8/1978 | Tomisawa et al. | 328/13 |
| 4,510,836 | 4/1985 | Markowitz | 84/626 |
| 4,969,385 | 11/1990 | Williams et al. | 84/656 |
| 5,099,741 | 3/1992 | Komatsu et al. | 84/653 |

*Primary Examiner*—William M. Shoop, Jr.

*Assistant Examiner*—Jeffrey W. Donels

*Attorney, Agent, or Firm*—Joseph C. Mason, Jr.; Ronald E. Smith

[57] ABSTRACT

A tone generating apparatus comprising a first tone signal generator including the same number of oscillators as a polyphonic number each for generating a tone signal of that tone component of tone components constituting a musical tone which has a relatively long tone-ON time; a first assigner for assigning tone generation to one of the oscillators of the first tone signal generator; a second tone signal generator including oscillators each for generating a tone signal of a different one of the tone components constituting a musical tone than the tone component having a relatively long tone-ON time, a quantity of the oscillators being less than the polyphonic number; and a second assigner for assigning tone generation to one of the oscillators of the second tone signal generator, whereby when a tone generation is specified, a tone signal output from one of the oscillators of the first tone signal generator assigned by the first assigner and a tone signal output from one of the oscillators of the second tone signal generator assigned by the second assigner are synthesized to produce a tone signal.

5 Claims, 8 Drawing Sheets

Fig. 5

ASSIGNER MEMORY A

| CHANNEL No. ℓ | KEY STATUS ST | KEY No. NO | PRESSING TIME |
|---|---|---|---|
| 1 | 1 | 25 | 1.175 |
| 2 | 1 | 26 | 1.189 |
| 3 | 0 | — | 0.512 |
| ⋮ | ⋮ | ⋮ | ⋮ |
| 32 | 1 | 10 | 2.318 |

KEY STATUS
{0 : RELEASE
1 : DEPRESS

Fig. 6

ASSIGNER MEMORY B

| CHANNEL No. m | KEY STATUS ST | KEY No. NO | PRESSING TIME |
|---|---|---|---|
| 1 | 1 | 30 | 1.238 |
| 2 | 1 | 33 | 1.342 |
| 3 | 0 | — | 0.256 |
| ⋮ | ⋮ | ⋮ | ⋮ |
| 14 | 1 | 10 | 2.318 |

Fig. 7

ASSIGNER MEMORY C

| CHANNEL No. n | KEY STATUS ST | KEY No. NO | PRESSING TIME |
|---|---|---|---|
| 1 | 1 | 17 | 2.209 |
| 2 | 1 | 10 | 2.318 |

TONE SIGNAL GENERATION FROM FEWER CIRCUITS

BACKGROUND OF THE INVENTION

1. Field of the Invention

The present invention relates to a tone generating apparatus for use in electronic musical instruments, such as a synthesizer, an electronic piano, an electronic organ and a single keyboard. More particularly, this invention pertains to a tone generating apparatus which is designed to need fewer oscillators without reducing the number of polyphonic sounds (simultaneously generating sounds).

2. Description of the Related Art

Conventional tone generating apparatuses for use in electronic musical instruments each have multiple digital control oscillators (DCOs) as tone generating sources. These DCOs are properly and selectively combined and driven in accordance with, for example, the timbre designated through an operation panel, or the tone range specified through a keyboard.

Such a tone generating apparatus is designed to simultaneously drive three oscillators when one key of a keyboard instrument is depressed. The individual oscillators produce the respective three tone components of a soft-hit component, a hard-hit component and a striking component. These tone components are combined to provide a single tone signal. This design is employed to ensure generation of musical tones close to sounds of a natural musical instrument.

The "soft-hit component" is a tone component whose frequency varies in proportion to the pitch and which has a relatively long tone-generating time or tone-ON time. The "hard-hit component" is a tone component whose frequency varies in proportion to the pitch and which has a relative short tone-ON time. The "striking component" is a tone component whose frequency should not necessarily be proportional to the pitch while having a shorter tone-ON time.

The ordinary tone generating apparatus is equipped with the same number of tone generating circuits each having the mentioned three oscillators as the number of polyphonic sounds.

As described above, in order to generate musical tones of hard-hit and striking components having a short tone-ON time, the conventional tone generating apparatus is provided with the same number of oscillators for each of the hard-hit and striking components as the number of oscillators for the soft-hit component having a long tone-ON time (the number of polyphonic sounds). At the time a musical tone is generated, channels are assigned to the oscillators for the individual tone components to generate the individual tone components simultaneously.

However, the hard-hit component is generated for a shorter period than the soft-hit component and has a shorter attenuation time, while the striking component does not vary in accordance with the pitch, i.e., the position of a depressed key and will attenuate immediately after it is generated for a short period of time.

To provide the same number of oscillators for generation of the hard-hit component or striking component that is generated only for a short period of time as the polyphonic number and assign a channel to the tone generation requires a great amount of hardware and results in a complicated structure. This design also impedes to the efficient use of the oscillators. These shortcomings inevitably make expensive electronic musical instruments to which the tone generating apparatus is applied.

SUMMARY OF THE INVENTION

It is therefore an object of this invention to provide a low-cost tone generating apparatus with a simple structure, which can be realized with fewer hardware without reducing the polyphonic number.

To achieve this object, the tone generating apparatus according to the present invention comprises first tone signal generating means including the same number of oscillators as a polyphonic number each for generating a tone signal of that tone component of tone components constituting a musical tone which has a relatively long tone-ON time, first assigner means for assigning tone generation to one of the oscillators of the first tone signal generating means, second tone signal generating means including oscillators each for generating a tone signal of other one of the tone components constituting a musical tone than the one having a relatively long tone-ON time, the quantity of the oscillators being less than the polyphonic number, and second assigner means for assigning tone generation to one of the oscillators of the second tone signal generating means, whereby when a tone generation is specified, the signals output from those oscillators assigned by the first and second assigner means are synthesized to produce a tone signal.

The present invention utilizes the characteristic that the tone-ON time varies depending on the tone components. More specifically, the tone generating apparatus embodying the present invention comprises at least first tone signal generating means including the same number of oscillators as a polyphonic number each for generating a tone signal of a tone component having a relatively long tone-ON time of a first predetermined duration, and second tone signal generating means including oscillators each for generating a tone signal of a tone component having a relatively short tone-ON time of a second predetermined duration, the quantity of the oscillators being less than the polyphonic number, whereby tone generation is assigned to given oscillators of the individual tone signal generating means to produce a tone signal. Since the time each oscillator of the second tone signal generating means occupies for tone generation is short, it is possible to frequently perform tone assignment, eliminating the need to provide the same number of oscillators of the second tone signal generating means as the polyphonic number.

For easy understanding of the present invention, a description will now be given of the case where tone generation is carried out with tone components classified into two type. As illustrated in FIG. 1 for a principle explanation, the tone generating apparatus comprises first tone signal generating means 51 including the same number of oscillators $\mathbf{51}_1$, $\mathbf{51}_2$, . . . , $\mathbf{51}_l$ as the polyphonic number 1, which each generate a tone component signal a having a long tone-ON time of said first predetermined duration, second tone signal generating means 57 including m+n oscillators $\mathbf{52}_1$, $\mathbf{52}_2$, . . . , $\mathbf{52}_m$, $\mathbf{53}_1$, $\mathbf{53}_2$, . . . , $\mathbf{53}_n$ which generate tone component signals b and c having a short tone-ON time of said second predetermined duration, m+n being smaller than the polyphonic number 1, first assigner means 54 for assigning tone generation to one of the oscillators $\mathbf{51}_1$, $\mathbf{51}_2$, . . . , $\mathbf{51}_l$ of the first tone signal generating means 51 when tone generation is instructed, and second assigner means 58 for assigning tone generation to one of the oscillators $52_1, 52_2, \ldots, 52_m, 53_1, 53_2, \ldots, 53_n$ of the second tone signal generating means 57 when tone generation is instructed.

Since the second tone signals b and c, e.g., the hard-hit component and striking component, have a property to be generated only for a short period of time, when tone generation is specified by depression of a key, for example, generation of a musical tone having a relatively long tone-ON time of such first predetermined duration is assigned to one of the oscillators $51_1, 51_2, \ldots, 51_l$ of the first tone signal generating means 51, and, at the same time, generation of a musical tone having a relatively short tone-ON time of said second predetermined duration is assigned to one of the oscillators $52_1, 52_2, \ldots, 52_m, 53_1, 53_2, \ldots, 53_n$ of the second tone signal generating means 57, thereby permitting these musical tones to be synthesized into a single tone signal. At this time, as any of the oscillators $52_1, 52_2, \ldots, 52_m, 53_1, 53_2, \ldots, 53_n$ of the second tone signal generating means 57 will be free in a short period of time, the next tone generation may be assigned to any of the oscillators even when some or all of the oscillators $51_1, 51_2, \ldots, 51_l$ of the first tone signal generating means 51 are generating the associated musical tones.

This design can reduce the number of the required oscillators without reducing the polyphonic number and can provide a tone generating apparatus with fewer hardware and a simple structure.

Further, a description will now be given of the case where tone generation is carried out with tone components classified into three type. As illustrated in FIG. 1 for a principle explanation, the tone generating apparatus comprises first tone signal generating means 51 including the same number of oscillators $51_1, 51_2, \ldots, 51_l$ as the polyphonic number 1, which each generate a tone component signal a having a long tone-ON time of said first predetermined duration, third tone signal generating means 52 including m oscillators $52_1, 52_2, \ldots, 52_m$, which generate tone component signals b having a medium tone-ON time of third predetermined duration, said third predetermined duration being less than said second predetermined duration, m being smaller than the polyphonic number 1, fourth tone signal generating means 53 including n oscillators $53_1, 53_2, \ldots, 53_n$ which generate tone component signals c having a shorter tone-ON time of fourth predetermined duration, said fourth predetermined duration being less than said third predetermined duration, n being smaller than m, first assigner means 54 for assigning tone generation to one of the oscillators $51_1, 51_2, \ldots, 51_l$ of the first tone signal generating means 51 when tone generation is instructed, third assigner means 55 for assigning tone generation to one of the oscillators $52_1, 52_2, \ldots, 52_m$ of the third tone signal generating means 52 when tone generation is instructed, and fourth assigner means 56 for assigning tone generation to one of the oscillators $53_1, 53_2, \ldots, 53_n$ of the fourth tone signal generating means 53 when tone generation is instructed.

Since the second tone signal b, e.g., the hard-hit component, has a property to be generated only for a short period of time, when tone generation is specified by depression of a key, for example, generation of a musical tone having a long tone-ON time is assigned to one of the oscillators $51_1, 51_2, \ldots, 51_l$ of the first tone signal generating means 51, and, at the same time, generation of a musical tone having a medium tone-ON time is assigned to one of the oscillators $52_1, 52_2, \ldots, 52_m$ of the third tone signal generating means 52, and generation of a musical tone having a short tone-ON time is assigned to one of the oscillators $53_1, 53_2, \ldots, 53_n$ of the fourth tone signal generating means 53, thereby permitting these musical tones to be synthesized into a single tone signal.

At this time, as any of the oscillators $52_1, 52_2, \ldots, 52_m$ of the third tone signal generating means 52 will be free in a short period of time, and any of the oscillators $53_1, 53_2, \ldots, 53_n$ of the fourth tone signal generating means 53 will be free in a shorter period of time, the next tone generation may be assigned to any of these oscillators $52_1, 52_2, \ldots, 52_m, 53_1, 53_2, \ldots, 53_n$ even when some or all of the oscillators $51_1, 51_2, \ldots, 51_l$ of the first tone signal generating means 51 are generating the associated musical tones.

This design can reduce the number of the required oscillators $52_1, 52_2, \ldots, 52_m$ of the third tone signal generating means 52 and $53_1, 53_2, \ldots, 53_n$ of the fourth tone signal generating means 53 without reducing the polyphonic number, and can provide a tone generating apparatus with fewer hardware and a simple structure.

BRIEF DESCRIPTION OF THE DRAWINGS

FIG. 5 is diagram exemplifying an assigner memory A according to the present invention;

FIG. 6 is diagram exemplifying an assigner memory B according to the present invention;

FIG. 7 is diagram exemplifying an assigner memory C according to the present invention;

DETAILED DESCRIPTION OF THE PREFERRED EMBODIMENT

Figure 1:
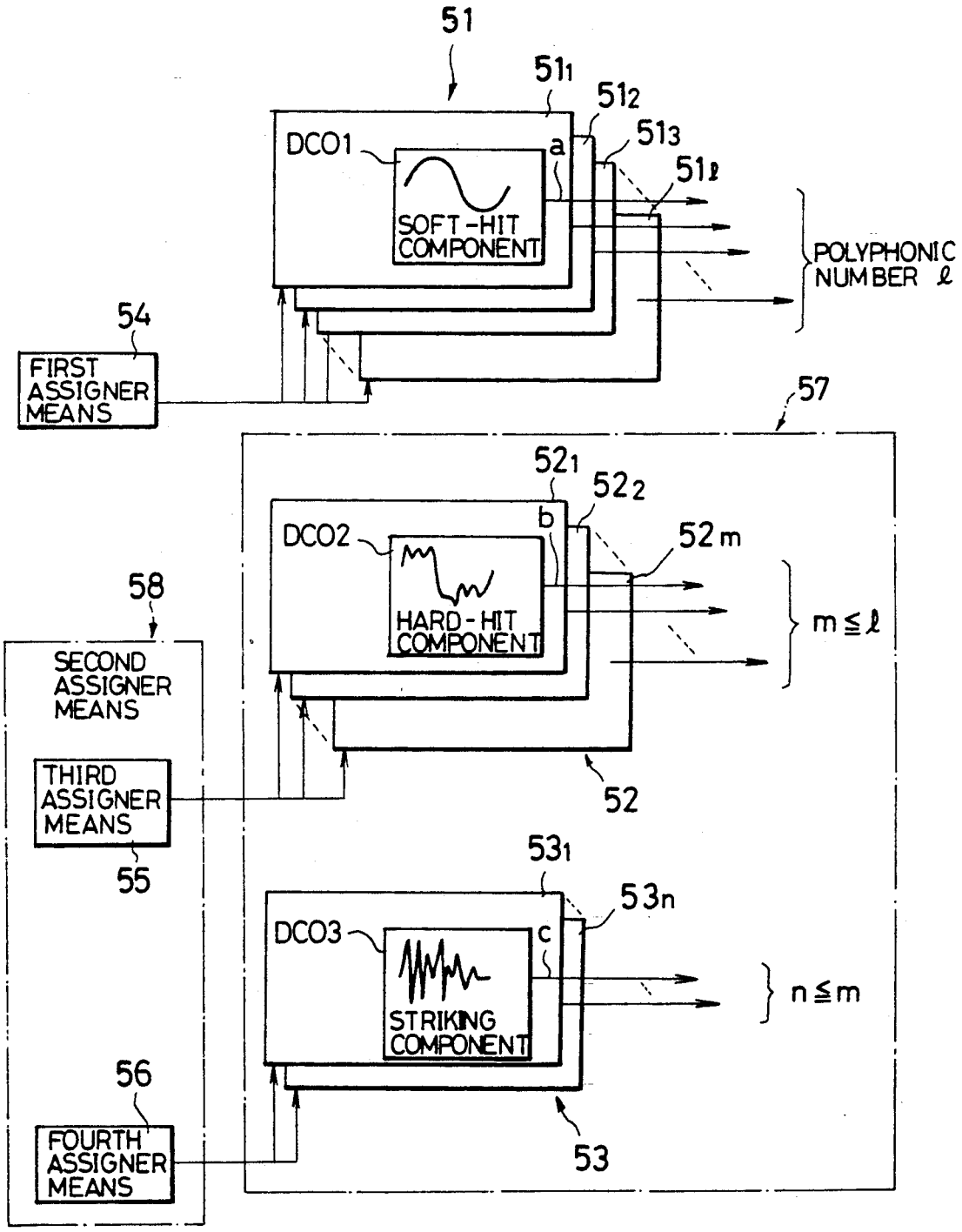
FIG. 1 is a diagram for explaining the principle of the present invention.
Figure 2:
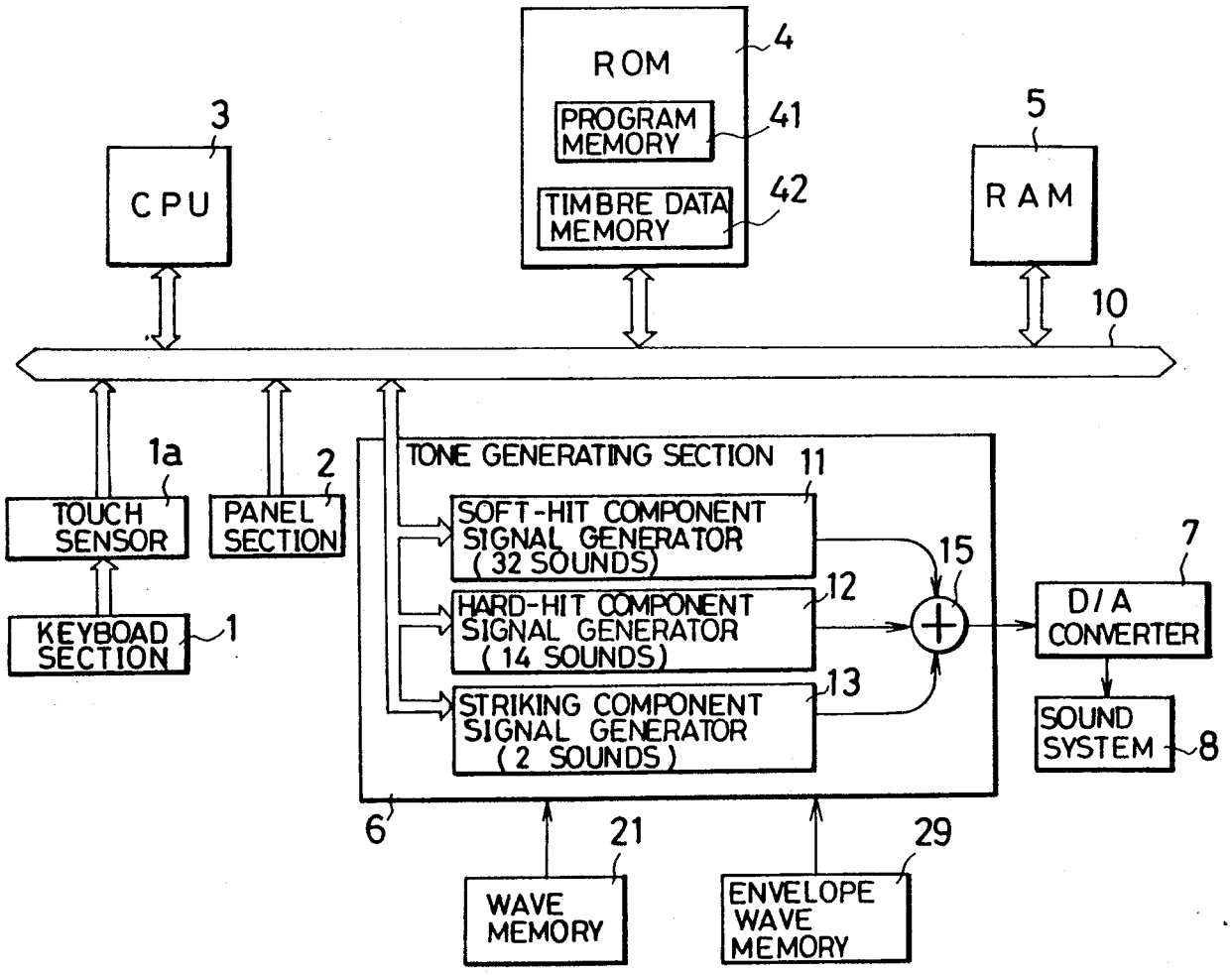
FIG. 2 is a block diagram showing the structures of the essential portions of an electronic musical instrument to which a tone generating apparatus of the present invention is applied.

FIG. 2 presents a block diagram illustrating the structures of the essential portions of an electronic musical instrument to which a tone generating apparatus according to the present invention is applied. The following description will be given with reference to the case where the number of polyphonic sounds is "32," which means that there are thirty-two oscillators each to generate a tone signal of a soft-hit component. It is assumed that there are fourteen oscillators for generating a tone signal of a hard-hit component and two oscillators for generating a tone signal of a striking component.

In FIG. 2, a keyboard section 1 comprises a plurality of keys. The keyboard section 1 also includes a key scan circuit (not shown) to detect the depression status of each key. Signals from the keyboard section 1 are sent to a touch sensor 1*a*.

The touch sensor la serves to detect the key touch strength in accordance with a signal from the keyboard section 1 sent together with an ON/OFF status signal of each key on the keyboard section 1, and sends its output as touch data. The touch data, the output of the touch sensor 1*a*, is sent to a CPU (Central Processing Unit) 3 through a system bus 10.

A panel section 2 includes various switches, such as a power switch, a mode select switch, a melody select switch and a rhythm select switch.

The CPU 3 controls the individual sections of the electronic musical instrument in accordance with a control program stored in a program memory section 41 in a ROM (Read Only Memory) 4.

The ROM 4 has a timbre data memory section 42 besides the program memory section 41. Stored in the timbre data memory section 42 is information for generating a musical tone, such as a frequency number, wave number, envelope wave number and mode data. The contents of the timbre data memory section 42 are specified by a timbre pointer. The data in the timbre data memory section 42 which is designed by the timbre pointer is read out in accordance with the operation of the panel section 2 and the operation of the keyboard section 1. The read-out contents of the ROM 4 are subjected to an arithmetic operation or the like before it is sent to the tone generating apparatus.

A RAM (Random Access Memory) 5 has a data area, multiple registers, assigner memories A, B and C, and the like allocated therein.

The data area serves to temporarily store predetermined data stored in the ROM 4 which is transferred under the control of the CPU 3.

The registers serve to hold data from the keyboard section 1 and the touch sensor 1*a*, which are associated with the statuses of the individual keys of the keyboard section 1, and data corresponding to the switch statuses of the panel section 2.

The assigner memories A, B and C store data for assigning DCOs (to be described later) to unused channels.

A tone generating section 6, which generates tone signals, comprises a soft-hit component signal generator 11 for generating a soft-hit component that is included in all the musical tones ranging from a soft-hit tone to a hard-hit tone, a hard-hit component signal generator 12 for generating a hard-hit component that becomes a high tone when a key is hit hard, a striking component signal generator 13 for generating a striking component when a key is struck, for example, and an adder 15 for adding signals from these signal generators.

The soft-hit component signal generator 11 is provided with thirty-two identical DCOs to ensure simultaneous generation of thirty-two musical tones. The hard-hit component signal generator 12 is provided with fourteen identical DCOs to ensure simultaneous generation of fourteen musical tones. The striking component signal generator 13 is provided with two identical DCOs to ensure simultaneous generation of two musical tones. The details of these DCOs will be given later.

To the tone generating section 6 are connected a wave memory 21 for storing wave data and an envelope wave memory 29 for storing envelope data. These memories will also be described in detail later.

A digital tone signal output from the tone generating section 6 is supplied to a D/A converter 7, which in turns converts the tone signal into an analog tone signal. The analog tone signal output from the D/A converter 7 is supplied to a sound system 8. The sound system 8 is of a well-known type, which comprises loudspeakers, or headphone or the like, for example, and releases a musical tone according to the received analog tone signal The aforementioned touch sensor 1*a* (keyboard section panel section 2, CPU 3, ROM 4, RAM 5 and tone generating section 6 are mutually connected by the aforementioned system bus 10.

Figure 3:
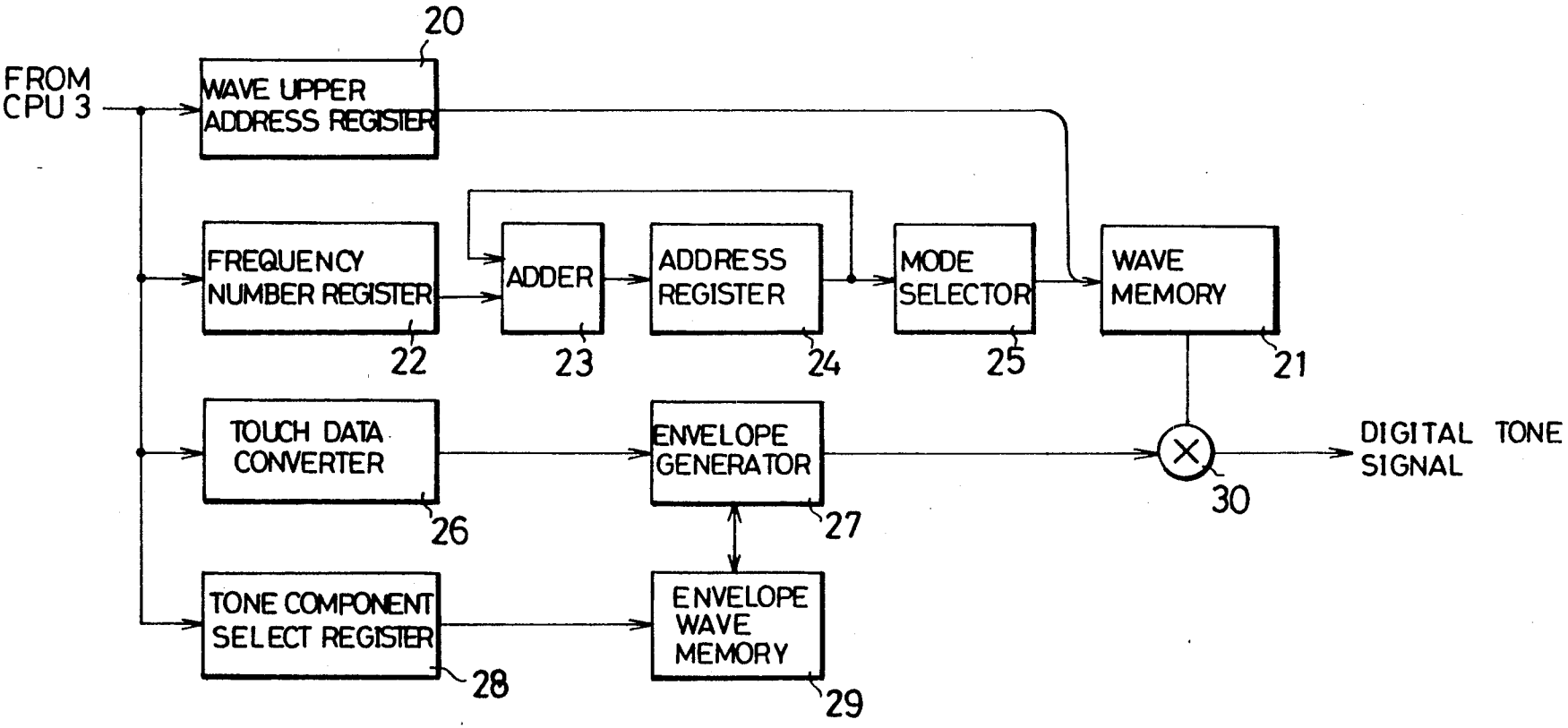
FIG. 3 is a block diagram illustrating the structure of a DCO according to one embodiment of the present invention.

FIG. 3 illustrates the detailed structure of a DCO. The DCOs of the aforementioned soft-hit component signal generator 11, hard-hit component signal generator 12, and striking component signal generator 13 all have the identical circuit structure. The DCOs of the individual signal generators respectively generate tone signals of the soft-hit component, hard-hit component and striking component under the control of the CPU 3.

Referring to FIG. 3, a wave upper address register stores a wave upper address sent from the CPU 3. The output of this address register 20 is supplied to the wave memory 21, and is used to select waves stored in the wave memory 21 in accordance with the timbre and tone range.

The wave memory 21 is a read only memory having wave data stored therein. This memory 21 outputs wave data from the area addressed by the wave upper address from the wave upper address register 20 and a wave lower address from a mode selector 25 which will be described later. The wave data is read out from the wave memory 21 at a speed (frequency) according to a frequency number which is generated in association with a key number.

A frequency number register 22 stores the frequency number sent from the CPU 3. The frequency number is used to control the speed for reading wave data from the wave memory 21. More specifically, the frequency number indicates an increase in a read address of the wave memory 21 at the time wave data is consecutively read out from the wave memory 21. Therefore, when the frequency number is small, wave data is read out with a small address increment, thus generating a tone signal of a low frequency. When the frequency number is large, however, wave data is read out with a large address increment, thus generating a tone signal of a high frequency. The output of the frequency number register 22 is sent to one input of an adder 23.

The adder 23 receives the output of the frequency number register 22 as one input and the output of an address register 24 as the other input and adds the inputs together. The output of the adder 23 or the result of the addition is supplied again to the address register 24.

The address register 24 stores the output of the adder 23. The address register 24 and the adder 23 constitute an accumulator. The contents of the address register 24 are supplied as a wave lower address via the mode selector 25 to the wave memory 21.

The mode selector 25 controls how to read wave data from the wave memory 21. The following modes are examples of the read modes. One mode is to sequentially read data from the area in the wave memory 21 specified by the wave upper address in an address-increasing direction, and then return to the start address and repeat the above operation when the last address is reached. Another mode is to sequentially read data from the area in the wave memory 21 specified by the wave upper address in the address-increasing direction, and then read data in an address-decreasing direction (reverse direction) when the last address is reached. These read modes, including other various modes, are all controlled by a control signal (not shown) from the CPU 3. The output of the mode selector 25 is supplied as a wave lower address to the wave memory 21.

A touch data converter 26 converts touch data of a predetermined format, sent from the CPU 3, into touch data of a format that allows the associated DCO to handle the data. The output of the touch data converter 26 is supplied to an envelope generator 27.

A tone-component select register 28 stores data that specifies the types of tone components, such as the soft-hit component, hard-hit component and striking component, sent from the CPU 3. The output of this register 28 is supplied to the aforementioned envelope wave memory 29.

The envelope wave memory 29 stores various types of envelope data according to tone components. This wave memory 29 is addressed by the contents of the tone-component select register 28 to select predetermined envelope data.

The envelope generator 27 sequentially reads out the envelope data selected by the tone-component select register 28, and generates an envelope signal with a level (amplitude) corresponding to the touch data from the touch data converter 26. The output of this envelope generator 27 is supplied to a multiplier 30.

The multiplier 30 multiplies wave data read out from the wave memory 21 by the envelope signal from the envelope generator 27. As a result, a digital tone signal having an envelope added to the wave data is generated. The output of the multiplier 30 is supplied to the adder 15 (see FIG. 2) as one tone component signal of a predetermined channel.

Referring to FIG. 3, the wave memory 21 and envelope wave memory 29 are shared by the individual DCOs, and the other portions are hardware provided in each DCO.

The above-described DCOs may be operated in a time-shared manner, in which case the amount of hardware required to constitute the DCOs can be reduced.

Figure 4:
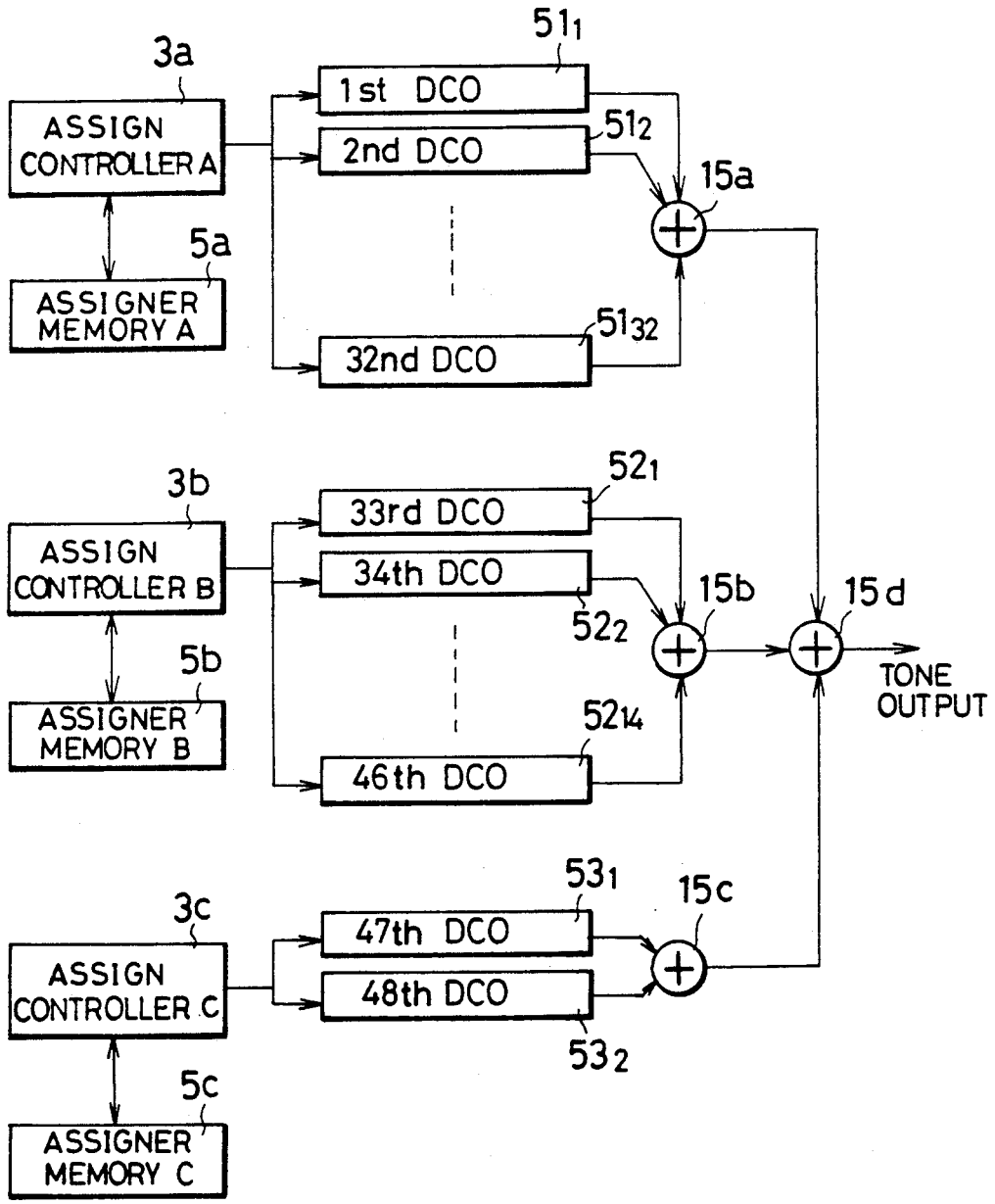
FIG. 4 is a block diagram showing the DCO and its control system according to the embodiment of the present invention.

FIG. 4 illustrate the structure of each DCO as an element of the tone generating section 6 and the structure of a control system for the DCO.

Referring to this diagram, first to thirty-second DCOs $\mathbf{51}_1$ to $\mathbf{51}_{32}$ correspond to the soft-hit component signal generator 11 comprising thirty-two DCOs (see FIG. 2), the thirty-third to forty-sixth DCOs $\mathbf{52}_1$ to $\mathbf{52}_{14}$ correspond to the hard-hit component signal generator 12 comprising fourteen DCOs, and the fourteen-seventh and fourteen-eighth DCOs $\mathbf{53}_1$ and $\mathbf{53}_2$ correspond to the striking component signal generator 13 comprising two DCOs. Adders 15*a*, 15*b* and 15*c* correspond to the adder 15 shown in FIG. 2.

An assign controller A 3*a*, which is realized by the function of the CPU 3, controls the 1st to 32nd DCOs $\mathbf{51}_1$ to $\mathbf{51}_{32}$. The assign controller A 3*a* performs a channel assign process in accordance with the contents of an assigner memory A 5*a* provided in the RAM 5.

An assign controller B 3*b*, which is also realized by the function of the CPU 3, controls the 33rd to 46th DCOs $\mathbf{52}_1$ to $\mathbf{52}_{14}$. The assign controller B 3*b* performs a channel assign process in accordance with the contents of an assigner memory B 5*b* also provided in the RAM 5.

An assign controller C 3*c*, which is likewise realized by the function of the CPU 3, controls the 47th and 48th DCOs $\mathbf{53}_1$ and $\mathbf{53}_2$. The assign controller C 3*c* performs a channel assign process in accordance with the contents of an assigner memory C 5*c* also provided in the RAM 5.

FIG. 5 exemplifies the assigner memory A. The assigner memory A is constituted by a channel number 1, a key status ST, a key number NO and a key-depressing time. The channel number 1 indicates one of first to thirty-second channels. The key status ST represents a key-released status when it is "0" and a key-depressed status when it is "1." The key number NO indicates the number of that key on the keyboard section 1 which is assigned to the channel 1. The key-depressing time is the time stored when that key has been depressed.

FIG. 6 exemplifies the assigner memory B, which has the same structure as the assigner memory A.

FIG. 7 exemplifies the assigner memory C, which has the same structure as the assigner memory A.

The operation of the tone generating apparatus having the above-described structure will be described below referring to the flowcharts given in FIGS. 8 and 9. Hereunder, the description will be given mainly with reference to the channel assign process.

Figure 8:
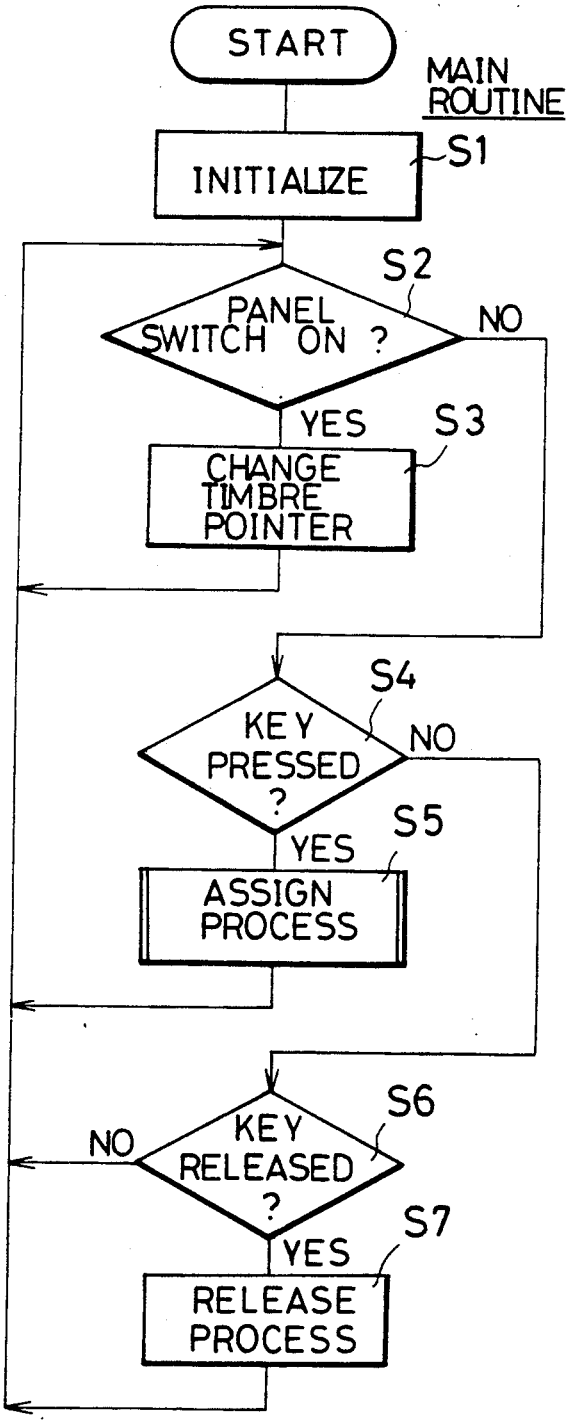
FIG. 8 is a flowchart (main routine) for explaining the operation of the embodiment of the present invention.

FIG. 8 shows the main routine for an electronic musical instrument. First, when the power switch on the panel section 2 is rendered ON, an initialization is executed (step S1). In the initialization, the registers in the CPU 3 and the registers allocated in the RAM 5 are initialized, predetermined data stored in the ROM 4 is transferred to the RAM 5, then, the timbre pointer is initialized to determine an initial timbre to be generated.

When this initialization is completed, it is determined whether or not any panel switch on the panel section 2 is set ON (step S2). If it is judged that one of the panel switches has been rendered ON, the timbre pointer is changed in accordance with the contents of that switch (step S3). Then, the flow returns to step S2 and the above process sequence will be repeated.

If it is judged in step S2 that no panel switch has been set ON, it is determined whether or not a key on the keyboard section 1 has been depressed (step S4). If it is judged that such key depression has occurred, an assign process will be executed (step S5).

This assign process assigns a DCO to a predetermined channel, transfers data, such as the frequency number, wave number, envelope wave number and mode data, associated with the depressed key, and then gives an instruction to start tone generation. As a result, the sound system 8 releases musical tones. Then, the flow returns to step S2 and the above process sequence will be repeated. The details of the assign process will be given later.

If it is judged in step S4 that no key has been depressed, it is determined whether or not any key release has occurred (step S6). If it is judged that key release has occurred, a key release process will be executed next (step S7).

In this key release process, the CPU 3 transfers predetermined data to the DCO which is presently generating the musical tone associated with the depressed key, and then instructs it to stop the tone generation. As a result, the sound system 8 stops generating the musical tone. Then, the flow returns to step S2 and the above process sequence will be repeated. Even if it is judged in step S6 that no key release has occurred, the flow returns to step S2 to repeat the process sequence.

By repeating the sequence of processes from steps S2 to S7, musical tones are generated while changing the timbre, pitch, etc. in accordance with the operation of the panel switches on the panel section 2 and the key operation of the keyboard section 1.

Figure 9:
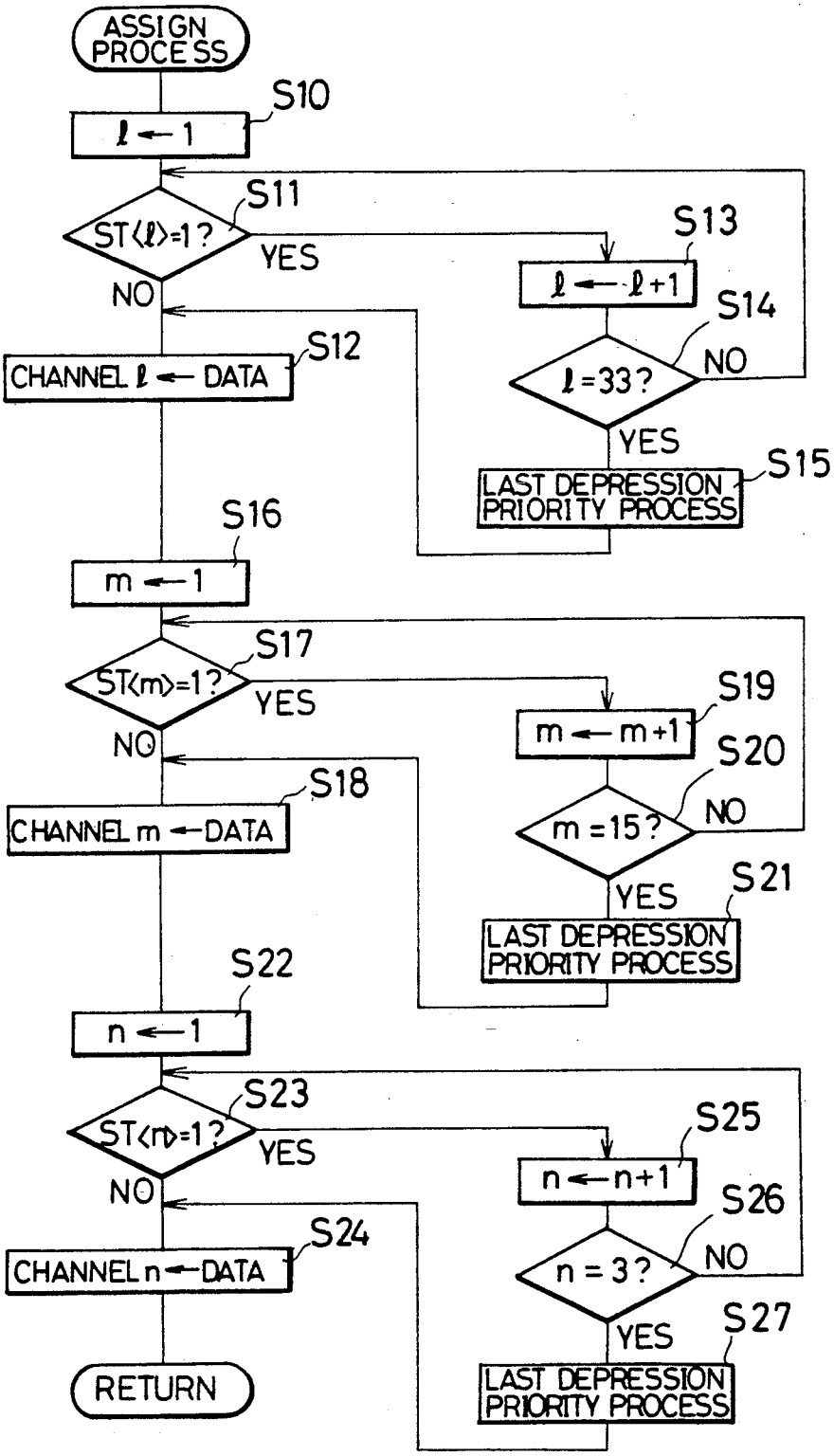
FIG. 9 is a flowchart (assigning routine) for explaining the operation of the embodiment of the present invention.

FIG. 9 presents a detailed flowchart of the assign process of step S5.

In the assign process, first, the channel number l is initialized to "1" (step S10). Then, the key status ST<l> of that channel number l of the assigner memory A is checked (step S11). When the key status ST of the key assigned to the channel number l is judged to be "1," i.e., when the key status is judged to be the key-depressed status, that channel cannot be used. Consequently, the channel number l is incremented (step S13), and it is then checked if the channel number l becomes "33" (step S14). If it is not judged that the channel number l is "33," the flow returns to step S11 to check the key status ST<l> for the next channel.

When a channel for which the key status ST is "0" or an unused channel is found through repetition of the above operation, the DCO is assigned to that channel and data is sent to the channel (step S12). As a result, the DCO for this channel is driven to generate a musical tone of a soft-hit component.

If it is judged in step S14 that the channel number l is "33," which means that all thirty-two channels are in use, a last depression priority process will be executed (step S15). More specifically, the key-depressing time table in the assigner memory A is checked and tone generation is assigned to that channel which has the oldest key-depressing time. And, data is sent to that channel (step S12).

In the next step S16, the channel number m is initialized to "1." Then, the key status ST<m> of that channel number m in the assigner memory B is checked (step S17). When the key status ST of the key assigned to the channel number m is judged to be "1," i.e., when that channel is already in use, the channel cannot be used. Consequently, the channel number m is incremented (step S19), and it is checked if the channel number m becomes "15" (step S20). If it is not judged that the channel number m is "15," the flow returns to step S17 to check the key status ST<m>for the next channel.

When a channel for which the key status ST is "0" or an unused channel is found through the above process sequence, data is sent to that channel (step S18). As a result, the DCO for this channel is driven to generate a musical tone of a hard-hit component.

If it is judged in step S20 that the channel number m is "15," which means that all the channels are in use, a last depression priority process will be executed (step S21). In other words, the key-depressing time table in the assigner memory B is checked and tone generation is assigned to that channel which has the older key-depressing time. And, data is sent to that channel (step S18).

Then, the channel number n is initialized to "1" (step S22), and the key status ST<n> of that channel number n in the assigner memory C is checked (step S23). When the key status ST of the key assigned to the channel number n is judged to be "1," i.e., when that channel is already in use, the channel cannot be used. Consequently, the channel number n is incremented (step S25), and it is checked if the channel number n becomes "3" (step S26). If it is not judged that the channel number n is "3," the flow returns to step S23 to check the key status ST<n> for the next channel.

When a channel for which the key status ST is "0" or an unused channel is found through the above process sequence, data is sent to that channel (step S24). As a result, the DCO for this channel is driven to generate a musical tone of a striking component.

If it is judged in step S26 that the channel number n is "3," which means that both of the two channels are in use, a last depression priority process will be executed (step S27). In other words, the key-depressing time table in the assigner memory C is checked and tone generation is assigned to that channel which has the older key-depressing time. And, data is sent to that channel (step S24).

As described above, the tone generating apparatus is provided with the same number of DCOs $\mathbf{51}_1$, $\mathbf{52}_2$, . . . , $\mathbf{51}_{32}$ as the polyphonic number "32," each of which generates a tone signal of a tone component having a long tone-ON time, such as a soft-hit component, is provided with "fourteen" DCOs $\mathbf{52}_1$, $\mathbf{52}_2$, . . . , $\mathbf{52}_{14}$, less than the polyphonic number, each of which generates a tone signal of a tone component having a medium tone-ON time, such as a hard-hit component, and is also provided with two DCOs $\mathbf{53}_1$ an $\mathbf{53}_2$, each of which generates a tone signal of a tone component, such as a striking sound, having a short tone-ON time, whereby a tone signal of a soft-hit component is generated by one of the tone generating circuits $\mathbf{51}_l$ to $\mathbf{51}_{32}$, while one of the DCOs $\mathbf{52}_1$ to $\mathbf{52}_{14}$ and one of the DCOs $\mathbf{53}_1$ and $\mathbf{53}_2$ are selected by a predetermined method to respectively generate tone signals of hard-hit and striking components. It is therefore possible to reduce the number of required DCOs and thus realize a tone generating apparatus with a simple structure by fewer hardware.

The tone generating apparatus according to the present invention will be described below in comparison with an ordinary tone generating apparatus shown in FIG. 10 to clarify the difference between the present apparatus and the conventional tone generating apparatus.

Figure 10:
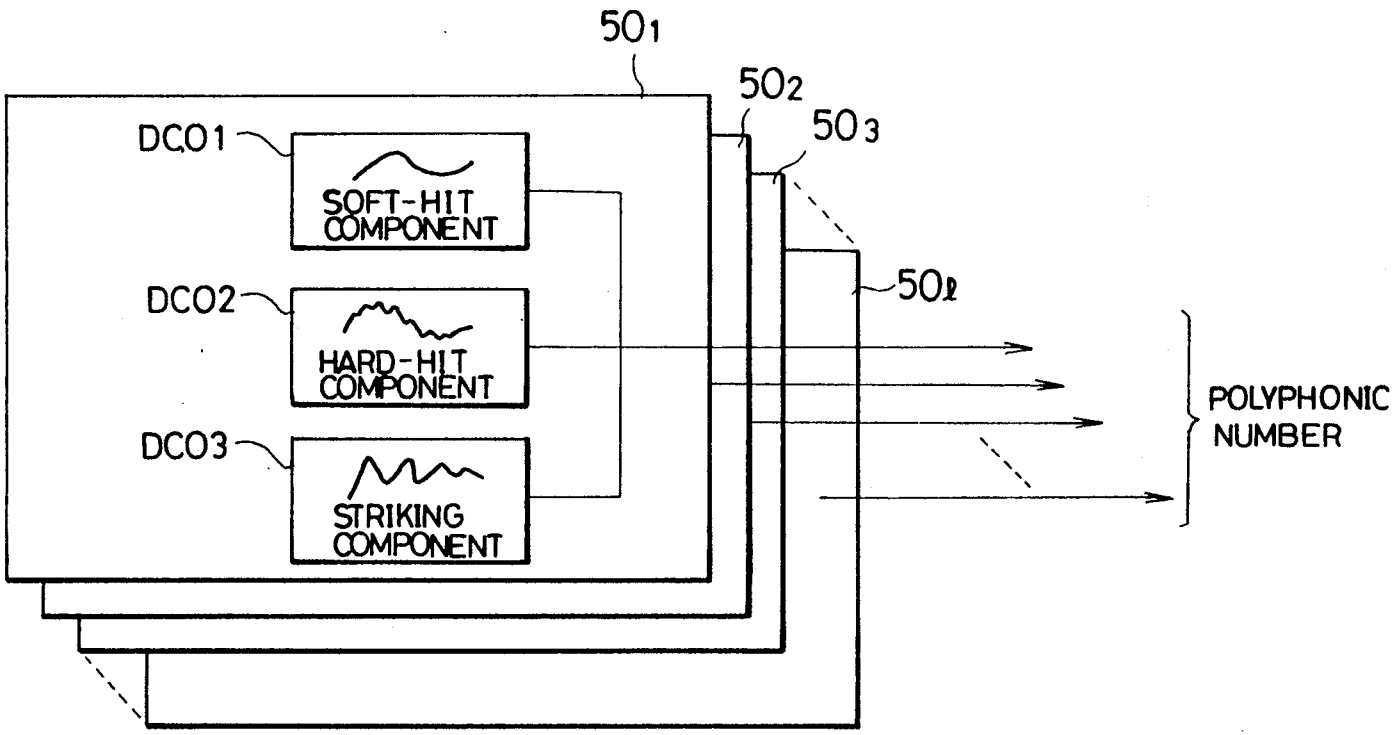
FIG. 10 is a diagram illustrating the structure of an ordinary tone generating apparatus to clarify how the present invention differs therefrom.

Referring to FIG. 10, reference numerals $\mathbf{50}_1$ to $\mathbf{50}_l$ are tone signal generating circuits which correspond to respective keys of a keyboard instrument, for example. When one key is depressed, three oscillators DCO 1 to DCO 3 of the associated tone signal generating circuit are simultaneously driven.

In the illustrated example, the DCO 1 is an oscillator for a tone signal of a soft-hit component, the DCO 2 for a tone signal of a hard-hit component, and the DCO 3 for a tone signal of a striking component. This apparatus is provided with the same number of DCOs each including these three oscillators, DCO 1 to DCO 3, as the number of polyphonic sounds.

The present invention can therefore reduce eighteen DCOs for a hard-hit component and 30 DCOs for a striking component, as compared with the respective DCOs used in the prior art tone generating apparatus, resulting in considerable reduction of hardware. The tone generating apparatus embodying the present invention therefore has a simpler structure and contributes to realizing low-cost electronic musical instruments.

While this embodiment has been described with reference to the case where the DCOs are classified into three groups respectively for a soft-hit component, a hard-hit component and a striking component, in accordance with the characteristics of tone components, the number of groups is not limited to three but may be any arbitrary number.

The foregoing description of this embodiment has been given with reference to the case where the tone generating apparatus is provided with fourteen DCOs $52_1$ to $52_{14}$ for generating a tone signal of a hard-hit component and two DCOs $53_1$ and $53_2$ for generating a tone signal of a striking component in addition to the same number of DCOs $51_1$, $51_2$, . . . , $51_{32}$ as the polyphonic number "32," each of which generates a tone signal of a soft-hit component having a relatively long tone-ON time. The polyphonic number is not however limited to thirty-two, but may be any arbitrary number. Further, the number of the DCOs for a hard-hit component and the number of the DCOs for a striking component are neither limited to fourteen and two, respectively. The object of the present invention can be achieved as long as the numbers of the latter two types of DCOs are less than the polyphonic number.

While the foregoing description of this embodiment has been given with reference to the case where a channel assignment when all the tone-ON channels are in use is performed with the priority given to the last-depressed key (last depression priority process), the method of the channel assignment is not limited to this particular type, but may be selected from various other methods. For instance, channel assignment to DCOs may be released sequentially from to those channels which are generating high-pitch tones while those channels generating low-pitch tones left intact.

As described above, the present invention can provide a low-cost tone generating apparatus with a simple structure having fewer hardware without reducing the polyphonic number.

What is claimed is:

1. A tone generating apparatus, comprising:

first tone signal generating means, said first tone signal generating means including a first predetermined plurality of oscillators, said predetermined number of oscillators being equal to a polyphonic number, each oscillator of said plurality of oscillators for generating a first tone signal of that component of tone components constituting a musical tone which has a tone-ON time of a first predetermined duration;

first assigner means for assigning tone generation to one of said oscillators of said first tone signal generating means;

second tone signal generating means including a second predetermined plurality of oscillators less than said polyphonic number, each oscillator of said second predetermined plurality of oscillators for generating a second tone signal of said tone components constituting a musical tone which has a tone-ON time of a second predetermined duration less than said first predetermined duration;

a third tone signal generating means having fewer oscillators than said second tone signal generating means, for generating a third tone signal of said tone components constituting a musical tone which has a tone-ON time of a third predetermined duration less than said second predetermined duration;

a fourth tone signal generating means having fewer oscillators than said third tone signal generating means, for generating a fourth tone signal of said tone components constituting a musical tone which has a tone-ON time of a fourth predetermined duration less than said third predetermined duration;

said third and fourth tone signal generating means forming said second tone signal generating means;

second assigner means for assigning tone generation to one of said oscillators of the third and fourth tone signal generating means;

third assigner means for assigning tone generation to one of said oscillators of said third tone signal generating means;

fourth assigner means for assigning tone generation to one of said oscillators of said fourth tone signal generating means; and adder means for synthesizing the signals output by assigned oscillators to produce a tone signal;

whereby only three groups of oscillators are required to produce four tone signal components.

2. A tone generating apparatus according to claim 1, wherein said oscillators are digital control oscillators.

3. A tone generating apparatus according to claim 1, wherein said tone component having a tone-ON time of said first predetermined duration is a soft-hit component whose frequency varies in proportion to a pitch.

4. A tone generating apparatus according to claim 1, wherein said tone components of said signals produced by said third tone signal generating means and having a tone-ON time of said third predetermined duration are hard-hit components whose frequency varies in proportion to a pitch.

5. A tone generating apparatus according to claim 1, wherein said tone component of said signals produced by said fourth tone signal generating means and having a tone-ON time of said fourth predetermined duration are striking components whose frequency is independent of a pitch.

* * * * *